US007121801B2

(12) United States Patent
Surace et al.

(10) Patent No.: US 7,121,801 B2
(45) Date of Patent: Oct. 17, 2006

(54) COOLED ROTOR BLADE WITH VIBRATION DAMPING DEVICE

(75) Inventors: Raymond C. Surace, Middletown, CT (US); Tracy A. Propheter, Manchester, CT (US)

(73) Assignee: United Technologies Corporation, Hartford, CT (US)

( * ) Notice: Subject to any disclaimer, the term of this patent is extended or adjusted under 35 U.S.C. 154(b) by 62 days.

(21) Appl. No.: 10/779,277

(22) Filed: Feb. 13, 2004

(65) Prior Publication Data

US 2006/0120875 A1 Jun. 8, 2006

(51) Int. Cl.
*F01D 5/16* (2006.01)

(52) U.S. Cl. ..... 416/193 A; 416/500; 416/224

(58) Field of Classification Search ..... 415/119; 416/193 A, 244, 500, 224
See application file for complete search history.

(56) References Cited

U.S. PATENT DOCUMENTS

| | | | | |
|---|---|---|---|---|
| 2,957,675 | A * | 10/1960 | Mason et al. | 416/220 R |
| 5,558,497 | A | 9/1996 | Kraft et al. | 416/96 |
| 5,820,343 | A | 10/1998 | Kraft et al. | 416/96 |
| 6,902,376 | B1 * | 6/2005 | Gautreau et al. | 416/219 R |

* cited by examiner

*Primary Examiner*—Ninh H. Nguyen

(57) ABSTRACT

A rotor blade for a rotor assembly is provided that includes a root, an airfoil, a platform, and a damper. The airfoil has at least one cavity. The platform is disposed between the root and the airfoil. The platform includes an inner surface, an outer surface, and a damper aperture disposed in the inner surface. The damper has a body and a base. The base and the damper aperture have mating geometries that enable the base to rotate within the damper aperture without substantial impediment from the mating geometries.

28 Claims, 4 Drawing Sheets

FIG.5A
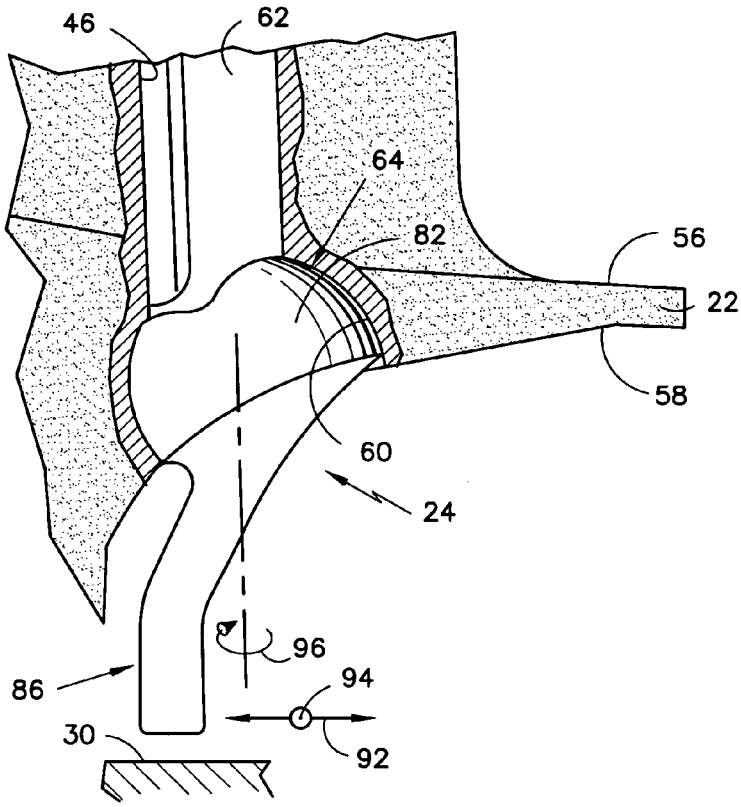
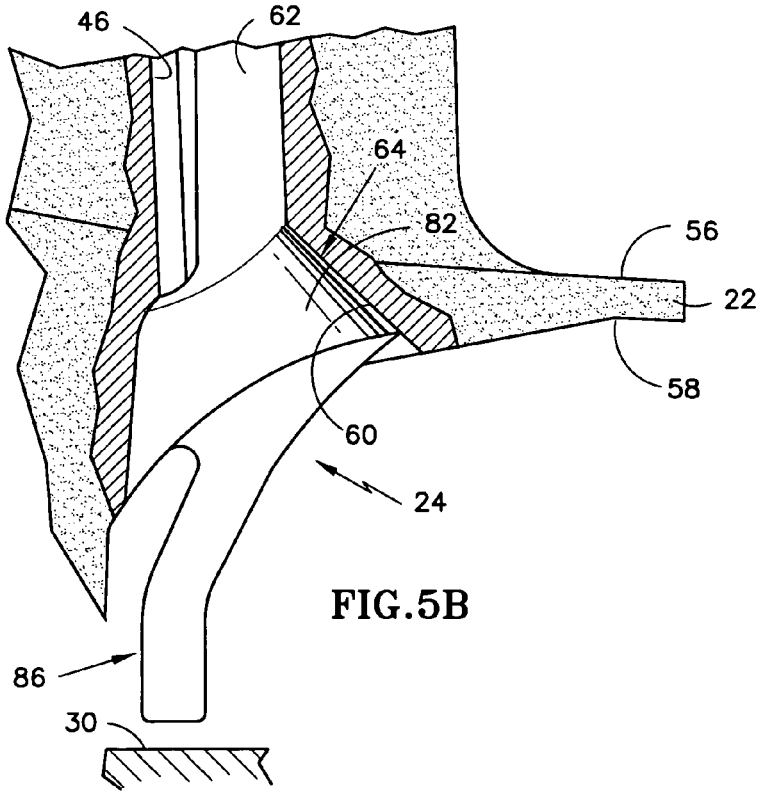
FIG.5B

COOLED ROTOR BLADE WITH VIBRATION DAMPING DEVICE

The invention was made under a U.S. Government contract and the Government has rights herein.

BACKGROUND OF THE INVENTION

1. Technical Field

This invention applies to rotor blades in general, and to apparatus for damping vibration within and cooling of a rotor blade in particular.

2. Background Information

Turbine and compressor sections within an axial flow turbine engine generally include a rotor assembly comprising a rotating disc and a plurality of rotor blades circumferentially disposed around the disk. Each rotor blade includes a root, an airfoil, and a platform positioned in the transition area between the root and the airfoil. The roots of the blades are received in complementary shaped recesses within the disk. The platforms of the blades extend laterally outward and collectively form a flow path for fluid passing through the rotor stage. The forward edge of each blade is generally referred to as the leading edge and the aft edge as the trailing edge. Forward is defined as being upstream of aft in the gas flow through the engine.

During operation, blades may be excited into vibration by a number of different forcing functions. Variations in gas temperature, pressure, and/or density, for example, can excite vibrations throughout the rotor assembly, especially within the blade airfoils. Gas exiting upstream turbine and/or compressor sections in a periodic, or "pulsating", manner can also excite undesirable vibrations. Left unchecked, vibration can cause blades to fatigue prematurely and consequently decrease the life cycle of the blades.

It is known that friction between a damper and a blade may be used as a means to damp vibrational motion of a blade.

One known method for producing the aforesaid desired frictional damping is to insert a long narrow damper (sometimes referred to as a "stick" damper) within a turbine blade. During operation, the damper is loaded against an internal contact surface within the turbine blade to dissipate vibrational energy. One of the problems with stick dampers is that they create a cooling airflow impediment within the turbine blade. A person of skill in the art will recognize the importance of proper cooling air distribution within a turbine blade. To mitigate the blockage caused by the stick damper, some stick dampers include widthwise (i.e., substantially axially) extending passages disposed within their contact surfaces to permit the passage of cooling air between the damper and the contact surface of the blade. Although these passages do mitigate the blockage caused by the damper, they only permit localized cooling at discrete positions. The contact areas between the passages remain uncooled, and therefore have a decreased capacity to withstand thermal degradation. Another problem with machining or otherwise creating passages within a stick damper is that the passages create undesirable stress concentrations that decrease the stick damper's low cycle fatigue capability.

In short, what is needed is a rotor blade having a vibration damping device that is effective in damping vibrations within the blade and that enables effective cooling of itself and the surrounding area within the blade.

DISCLOSURE OF THE INVENTION

It is, therefore, an object of the present invention to provide a rotor blade for a rotor assembly that includes means for effectively damping vibration within that blade.

According to the present invention, a rotor blade for a rotor assembly is provided that includes a root, an airfoil, a platform, and a damper. The airfoil has at least one cavity disposed between a first side wall and a second side wall. The platform is disposed between the root and the airfoil. The platform includes an inner surface, an outer surface, and a damper aperture disposed in the inner surface. The damper has a body and a base. The base and the damper aperture have mating geometries that enable the base to rotate within the damper aperture without substantial impediment from the mating geometries.

According to one aspect of the present invention, the damper further includes a retention tang extending outwardly from the base.

An advantage of the present invention is that the damper can move during operation to accommodate centrifugal and pressure differential loading without incurring undesirable stress in the damper base region that would likely develop if the base were positionally fixed within a damper aperture disposed within or below the platform.

Another advantage of the present invention is that the retention tang facilitates installation and disassembly of the damper from the blade. In some prior art applications, the damper was fixed within the rotor blade by braze or weld. If the useful life of the damper was less than that of the rotor blade, it would be necessary to remove braze or weld material to remove the damper. The present invention tang obviates the need to fix the damper within the rotor blade.

These and other objects, features and advantages of the present invention will become apparent in light of the detailed description of the best mode embodiment thereof, as illustrated in the accompanying drawings.

BRIEF DESCRIPTION OF THE DRAWINGS

FIG. 5A is a diagrammatic partial view of rotor assembly, partially sectioned, illustrating a damper embodiment mounted within a rotor blade.

FIG. 5B is a diagrammatic partial view of rotor assembly, partially sectioned, illustrating a damper embodiment mounted within a rotor blade.

BEST MODE FOR CARRYING OUT THE INVENTION

Figure 1:
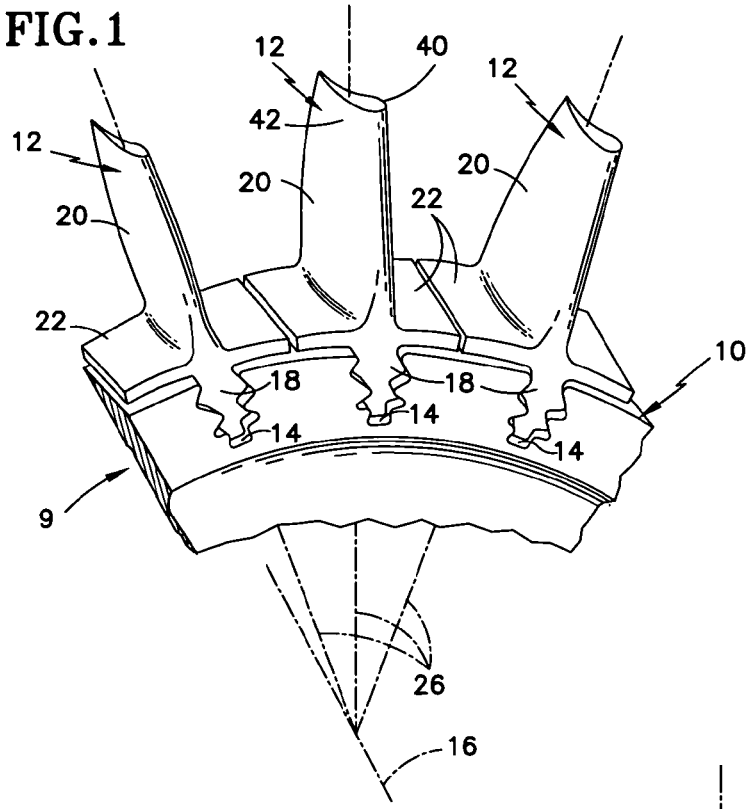
FIG. 1 is a partial perspective view of a rotor assembly.
Figure 2:
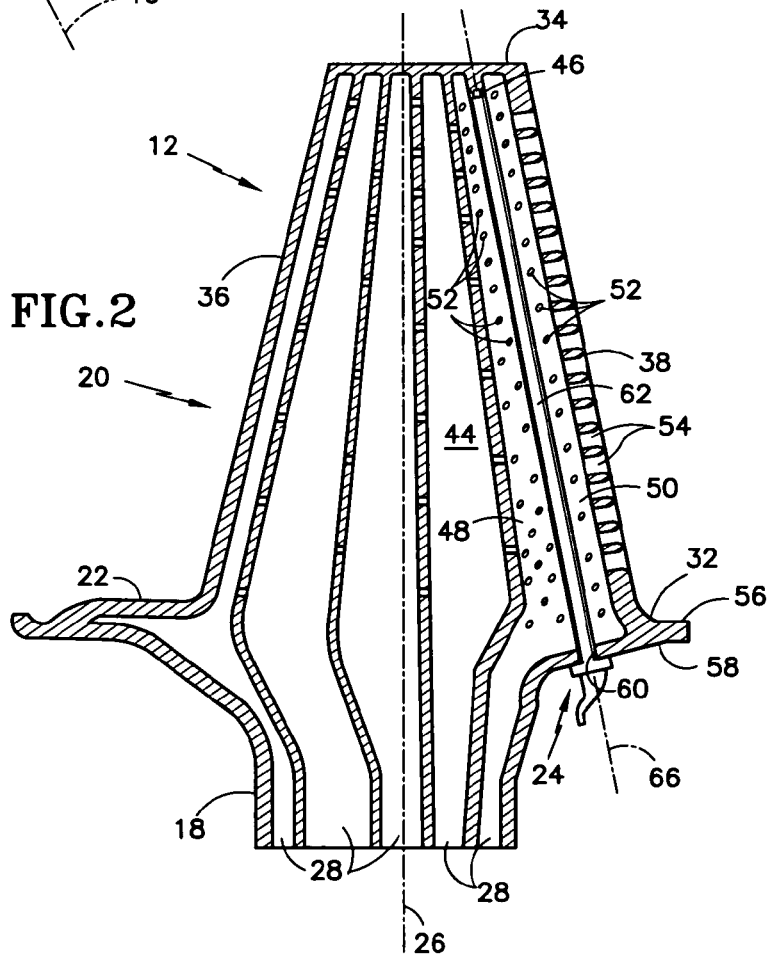
FIG. 2 is a diagrammatic sectioned view of a rotor blade.
Figure 3:
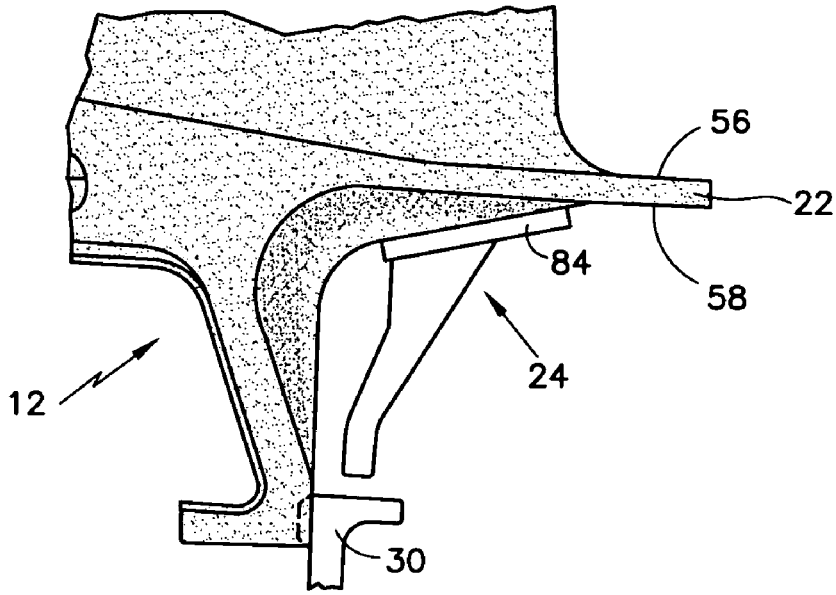
FIG. 3 is a diagrammatic partial view of rotor assembly, illustrating a damper embodiment mounted within a rotor blade.
Figure 4:
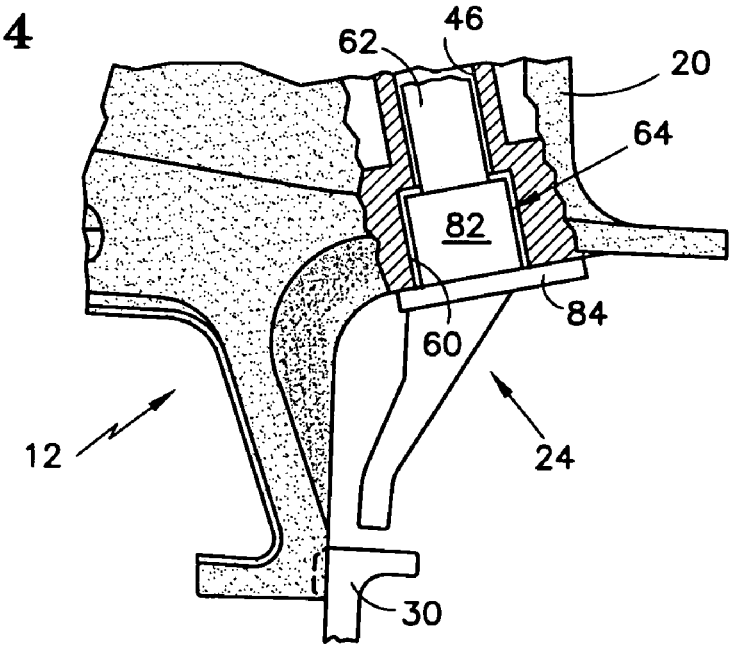
FIG. 4 is a partially sectioned view of the view shown in FIG. 3.
Figure 6:
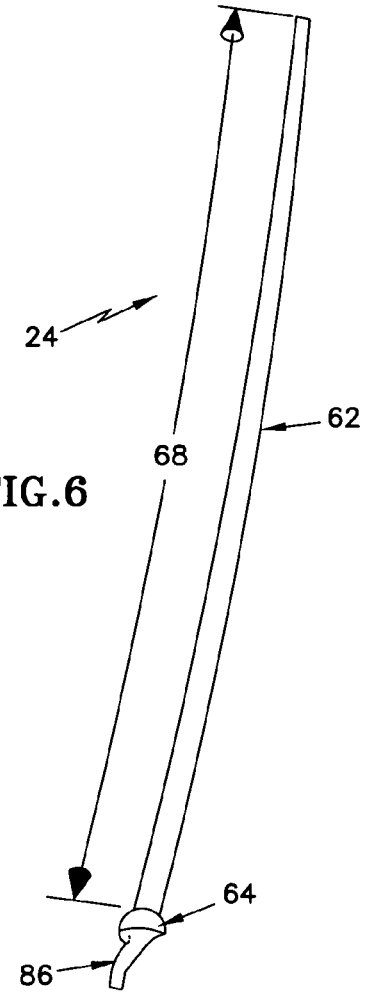
FIG. 6 is a perspective view of a damper embodiment.
Figure 7:
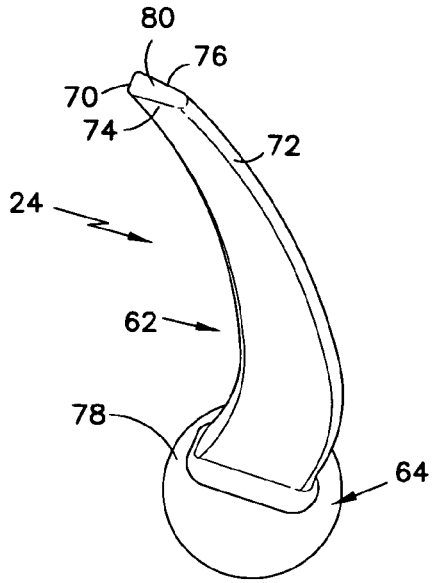
FIG. 7 is a perspective view of a damper embodiment.
Figure 8:
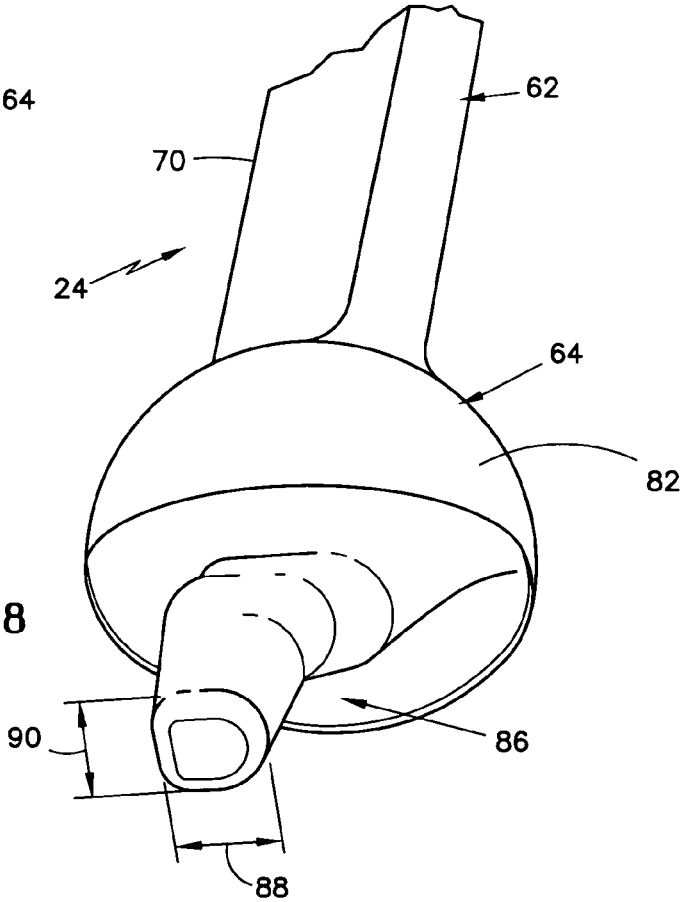
FIG. 8 is a partial perspective view of a damper embodiment.

Referring to FIGS. 1–4, a rotor blade assembly 9 for a gas turbine engine is provided having a disk 10 and a plurality of rotor blades 12. The disk 10 includes a plurality of recesses 14 circumferentially disposed around the disk 10 and a rotational centerline 16 about which the disk 10 may rotate. Each blade 12 includes a root 18, an airfoil 20, a platform 22, and a damper 24 (see FIG. 2). Each blade 12 also includes a radial centerline 26 passing through the blade 12, perpendicular to the rotational centerline 16 of the disk 10. The root 18 includes a geometry that mates with that of one of the recesses 14 within the disk 10. A fir tree configuration is commonly known and may be used in this instance. As can be seen in FIG. 2, the root 18 further includes conduits 28 through which cooling air may enter the root 18 and pass through into the airfoil 20. As can be seen in FIGS. 3 and 4, a retainer ring 30 is disposed adjacent the aft portion of the disk 10.

Referring to FIG. 2, the airfoil 20 includes a base 32, a tip 34, a leading edge 36, a trailing edge 38, a pressure side wall 40 (see FIG. 1), a suction side wall 42 (see FIG. 1), a cavity 44 disposed therebetween, and a channel 46. FIG. 2 diagrammatically illustrates an airfoil 20 sectioned between the leading edge 36 and the trailing edge 38. The pressure side wall 40 and the suction side wall 42 extend between the base 32 and the tip 34 and meet at the leading edge 36 and the trailing edge 38. The cavity 44 can be described as having a first cavity portion 48 forward of the channel 46 and a second cavity portion 50 aft of the channel 46. In an embodiment where an airfoil 20 includes a single cavity 44, the channel 46 is disposed between portions of the one cavity 44. In an embodiment where an airfoil 20 includes more than one cavity 44, the channel 46 may be disposed between adjacent cavities 44. To facilitate the description herein, the channel 46 will be described herein as being disposed between a first cavity portion 48 and a second cavity portion 50, but is intended to include multiple cavity and single cavity airfoils 20 unless otherwise noted. In the embodiment shown in FIG. 2, the second cavity portion 50 is proximate the trailing edge 38, and both the first cavity portion 48 and the second cavity portion 50 include a plurality of pedestals 52 extending between the walls of the airfoil 20. In alternative embodiments, only one or neither of the cavity portions 48,50 contain pedestals 52, and the channel 46 is defined forward and aft by ribs with cooling apertures disposed therein. A plurality of ports 54 are disposed along the aft edge of the second cavity portion 50, providing passages for cooling air to exit the airfoil 20 along the trailing edge 38. The channel 46 for receiving the damper 24 is described herein as being located proximate the trailing edge. The channel 46 and the damper 24 are not limited to a position proximate the trailing edge 38 and may be positioned elsewhere within the airfoil; e.g., proximate the leading edge 36.

The channel 46 between the first and second cavity portions 48,50 is defined laterally by a first wall portion and a second wall portion that extend lengthwise between the base 32 and the tip 34, substantially the entire distance between the base 32 and the tip 34. The channel 46 is defined forward and aft by a plurality of pedestals 52 or a rib, or some combination thereof. One or both wall portions include a plurality of raised features (not shown) that extend outwardly from the wall into the channel 46. Examples of the shapes that a raised feature may assume include, but are not limited to, spherical, cylindrical, conical, or truncated versions thereof, of hybrids thereof. U.S. patent application Ser. No. 10/741,103 filed on Dec. 19, 2003 and assigned to the assignee of the present application, discloses the use of raised features within a channel, and is hereby incorporated by reference herein.

The platform 22 includes an outer surface 56, an inner surface 58, and a damper aperture 60 disposed in the inner surface 58. The outer surface 56 defines a portion of the core gas flow path through the rotor blade assembly 9, and the inner surface 58 is disposed opposite the outer surface 56. The damper aperture 60 connects with the channel 46 disposed within the airfoil 20, thereby enabling the channel 46 to receive the body 62 of the damper 24. The damper aperture 60 has a geometry that mates with a portion of the damper 24 in a manner that enables the base to move within the damper aperture 60 without impediment from the mating geometries, as will be described below.

Referring to FIGS. 5A–8, the damper 24 includes a body 62, a base 64, and a lengthwise extending centerline 66 (see FIG. 2). The body includes a length 68, a forward face 70, an aft face 72, a first bearing surface 74, a second bearing surface 76, a base end 78, and a tip end 80. The damper body 62 may have a straight or an arcuate lengthwise extending centerline 66 (see FIG. 2), and may be oriented at an angle such that when installed within the rotor blade 12 a portion or all of the body 62 is skewed from the radial centerline 26 of the blade 12. The angle at which the portion or all of the body 62 is skewed from the radial centerline 26 of the blade 12 is referred to hereinafter as the lean angle of the damper body 62 within the blade 12. The damper body 62 is shaped in cross-section to mate with the cross-sectional shape of the channel 46; i.e., the general cross-sectional shape of the damper body 62 mates with cross-sectional shape of the channel 46. In those instances where the channel 46 includes raised features, the raised features may define the cross-sectional profile of the channel 46.

As disclosed above, a portion 82 of the damper base 64 has a geometry that mates with the geometry of the damper aperture 60. This portion 82 may be referred to as a bearing surface portion. The mating geometries enable the base 64 to move within the aperture 60 without substantial impediment from the mating geometries. The phrase "without impediment from the mating geometries" is defined herein as meaning that the mating geometries will not substantially impede movement of the base 64 within the aperture 60. Friction between the bearing surface portion 82 of the base 64 and the aperture 60 is not considered herein as being a substantial impediment to the movement of the base 64 within the aperture 60. An example of mating geometries that enable the base 64 to move within the aperture 60 is a cylindrical bearing surface portion 82 of the base 64 received within a cylindrical damper aperture 60. FIGS. 3 and 4 show an example of a base 64 having a flat plate portion 84 and a cylindrical bearing surface portion 82, the latter received within a cylindrical aperture 60 disposed within the platform 22. The mating geometries do not necessarily enable 360° of rotation between the damper base 64 and damper aperture 60, however. In those applications where the damper body 62 is not rotatable within the channel 46, for example, the damper base 64 will not be 360° rotatable within the damper aperture 60. In this example, it is not the mating geometries of the base 64 and the aperture 60 that prevent 360° rotation of the damper 24. Rather, it is the geometries of the damper body 62 and the channel 46 that prevent 360° rotation of the damper 24. In such an instance, the base 64 is free to rotate within the aperture 60 an amount encountered during normal operation of the rotor assembly. The flat plate portion 84 of the damper 24 provides a sealing surface against a platform inner surface 58. The seal between the flat plate portion 84 and the inner surface 58 helps to minimize leakage of cooling air out of the channel 46.

In a preferred embodiment, the mating geometries enable the base 64 to move within the aperture 60 with at least three degrees of freedom without substantial impediment from the mating geometries (e.g., axially, circumferentially, and rotationally). Axial movement is shown in FIG. 5A by arrow 92, which corresponds to movement within the plane of the page. Circumferential movement is shown in FIG. 5A by arrow 94, which corresponds to movement in and out of the plane of the page. Rotational movement is shown in FIG. 5A by arrow 96, which corresponds to movement around an axis within the plane of the page. The terms "axial", "circumferential", and "rotational" are used to illustrate relative movement. The terms "axial" and "circumferential" are chosen to substantially align with the axial and circumferential directions generally denoted within a gas turbine. Examples of mating base 64 and aperture 60 geometries that enable the base 64 to move within the aperture 60 with at least three degrees of freedom without substantial impediment include apertures 60 that have a spherical (see FIG. 5A), toroidal, or conical shape (see FIG. 5B), and bases 64 that have a spherical or conical shape. The present damper aperture and damper base geometries are not, however, limited to these examples. The mating geometries of the damper base 64 and the apertures 60 combine to provide a sealing surface that helps to minimize leakage of cooling air out of the channel 46.

In some embodiments, the damper 24 further includes a tang 86 extending outwardly from the base. In some embodiments, the tang 86 is shaped to engage another element that is a part of, or adjacent, the rotor assembly; e.g., a retainer ring 30 disposed adjacent the rotor assembly. The retainer ring 30 shown in FIGS. 3 and 4 is shown positioned adjacent the aft portion of the disk 10. The retainer ring 30, or other element that is a part of, or adjacent, the rotor assembly may be positioned forward of the disk as well. As a result, in these embodiments the tang 86 operates to maintain engagement of the damper 24 with the rotor blade 12.

In addition to, or independent of, the shape that enables the tang 86 to engage other elements, the tang 86 also has a first cross-sectional profile 88 and a second cross-sectional profile 90. The first and second cross-sectional profiles 88,90 are, in some embodiments, substantially perpendicular to one another and dissimilar in size to reduce windage and/or to provide aerodynamic loads for positioning the damper 24. For example, the tang 86 shown in FIG. 8 has a first cross-sectional profile 88 that is larger in cross-sectional area than the substantially perpendicular second cross-sectional profile 90. If it is desirable to reduce the windage of the tang 86 within the engine region adjacent the rotor assembly, the tang 86 would be oriented within the engine region such that the first cross-sectional profile 88 is parallel to the direction of airflow in that engine region, and the area of the second cross-sectional profile 90 (oriented substantially perpendicular to the airflow) would be kept to a minimum. If it is desirable to load the damper 24 to create particular positioning characteristics, the area of the second cross-sectional profile 90 can be increased. In addition, if it is desirable to subject the damper 24 to a rotational moment, the first and second cross-sectional profiles 88,90 can be skewed relative to the direction of the airflow within the engine region in which the tang 86 is disposed.

Referring to FIGS. 1–8, under steady-state operating conditions, a rotor blade assembly 9 within a gas turbine engine rotates through core gas flow passing through the engine. As the rotational speed of the rotor assembly 9 increases, the rotor blade 12 and the damper 24 disposed therein are subject to increasingly greater centrifugal forces. Initially, the centrifugal forces acting on the damper 24 will overcome the weight of the damper 24 and cause the damper 24 to contact the damper aperture 60 disposed within the inner radial surface of the platform 22. As the rotational speed increases, a component of the centrifugal force acting on the damper 24 acts in the direction of the wall portions of the channel 46; i.e., the centrifugal force component acts as a normal force against the damper 24 in the direction of the wall portions of the channel 46. If the channel path is skewed from the radial centerline of the blade 12, the base 64 of the damper 24 may rotate and/or pivot within the damper aperture 60. In addition, if the damper 24 includes a tang 86, air acting on that tang 86 may cause the base 64 of the damper 24 to rotate and/or pivot within the damper aperture 60.

Although this invention has been shown and described with respect to the detailed embodiments thereof, it will be understood by those skilled in the art that various changes in form and detail thereof may be made without departing from the spirit and the scope of the invention.

What is claimed is:

1. A rotor blade for a rotor assembly, comprising:

a root;

an airfoil having at least one cavity;

a platform disposed between the root and the airfoil, the platform having an inner surface, an outer surface, and a damper aperture disposed in the inner surface; and a damper having a body and a base;

wherein the base and the damper aperture have mating geometries that enable the base to move within the aperture without substantial impediment from the mating geometries.

2. The rotor blade of claim 1, wherein the mating geometries are such that the base is operable to rotate within the aperture without substantial impediment from the mating geometries.

3. The rotor blade of claim 1, wherein the mating geometries are such that the base is operable to move axially within the aperture without substantial impediment from the mating geometries.

4. The rotor blade of claim 1, wherein the mating geometries are such that the base is operable to move circumferentially within the aperture without substantial impediment from the mating geometries.

5. The rotor blade of claim 1, wherein the mating geometries permit three degree of freedom movement between the base and the damper aperture during operation of the rotor blade.

6. The rotor blade of claim 5, wherein a bearing portion of the base is spherically shaped.

7. The rotor blade of claim 5, wherein a bearing portion of the base is conically shaped.

8. The rotor blade of claim 5, wherein the damper aperture is toroidally shaped.

9. The rotor blade of claim 1, wherein the damper further comprises a tang extending outwardly from the base.

10. The rotor blade of claim 9, wherein the tang is operably shaped to retain engagement of the tang with the rotor blade.

11. The rotor blade of claim 9, wherein the tang has a first cross-sectional profile and a second cross-sectional profile, and the first cross-sectional profile and the second cross-sectional profile are disposed substantially perpendicular to one another.

12. The rotor blade of claim 11, wherein the first cross-sectional profile and the second cross-sectional profile are dissimilar in size.

13. The rotor blade of claim 11, wherein the first cross-sectional profile and the second cross-sectional profile are oriented so as to be skewed from the airflow direction passing the tang during operation.

14. A rotor assembly, comprising:

a disk; and a plurality of rotor blades selectively attachable to the disk, each rotor blade having a root, an airfoil having at least one cavity, a platform disposed between the root and the airfoil, wherein the platform has an inner surface, an outer surface, and a damper aperture disposed in the inner surface, and each rotor blade has a damper having a body and a base, wherein the base and the damper aperture have mating geometries that enable the base to rotate within the aperture without substantial impediment from the mating geometries.

15. The rotor assembly of claim 14, wherein the mating geometries permit three degree of freedom movement between the base and the damper aperture during operation of the rotor blade.

16. The rotor assembly of claim 14, wherein each damper further comprises a tang extending outwardly from the base.

17. The rotor assembly of claim 16, further comprising a retainer ring disposed proximate the tang of each damper.

18. The rotor blade of claim 16, wherein the tang is operably shaped to retain engagement of the tang with the rotor blade.

19. The rotor assembly of claim 16, wherein each tang has a first cross-sectional profile and a second cross-sectional profile, and the first cross-sectional profile and the second cross-sectional profile are disposed substantially perpendicular to one another.

20. The rotor assembly of claim 16, wherein the first cross-sectional profile and the second cross-sectional profile of each rotor blade are dissimilar in size.

21. The rotor assembly of claim 20, wherein the first cross-sectional profile and the second cross-sectional profile are oriented so as to be skewed from the airflow direction passing the tang during operation.

22. A damper for use in a rotor blade having an airfoil, the damper comprising:

a base having a bearing surface portion shaped to permit movement of the damper within the rotor blade; and a body extending outwardly from the base and receivable within said airfoil.

23. The damper of claim 22, wherein the bearing surface portion is at least in part shaped spherically.

24. The damper of claim 22, wherein the bearing surface portion is at least in part shaped conically.

25. The damper of claim 24, wherein the tang is operably shaped to retain engagement of the tang with a rotor blade.

26. The damper of claim 22, further comprising a tang extending outwardly from the base.

27. The damper of claim 26, wherein the tang has a first cross-sectional profile and a second cross-sectional profile, and the first cross-sectional profile and the second cross-sectional profile are disposed substantially perpendicular to one another.

28. The damper of claim 27, wherein the first cross-sectional profile and the second cross-sectional profile are dissimilar in size.

* * * * *